United States Patent [19]

Fenwick et al.

[11] Patent Number: 4,570,675

[45] Date of Patent: Feb. 18, 1986

[54] PNEUMATIC SIGNAL MULTIPLEXER

[75] Inventors: Danny L. Fenwick, Springdale; Charles M. Stanforth, Cincinnati, both of Ohio

[73] Assignee: General Electric Company, Cincinnati, Ohio

[21] Appl. No.: 443,825

[22] Filed: Nov. 22, 1982

[51] Int. Cl.[4] ..... F15C 4/00; F15C 1/08; H01H 35/24; H01H 35/40

[52] U.S. Cl. ..... 137/805; 137/821; 137/835; 137/826; 200/81.4; 200/81.9 R

[58] Field of Search ..... 235/200 R, 201 PF, 201 MC, 235/201 R, 201; 137/805, 817, 819, 821, 826, 835, 557; 251/136 T; 200/81.9, 81.4

[56] References Cited

U.S. PATENT DOCUMENTS

| | | | |
|---|---|---|---|
| 3,114,390 | 12/1963 | Glattli | 137/597 |
| 3,117,593 | 1/1964 | Sowers, III | 137/624.14 |
| 3,403,509 | 10/1968 | Eastman et al. | 60/39.28 |
| 3,433,408 | 3/1969 | Bellman et al. | 235/201 |
| 3,521,655 | 7/1970 | Glaze | 137/81.5 |
| 3,788,357 | 1/1974 | Welk, Jr. | 137/805 |
| 4,144,906 | 3/1979 | Funke et al. | 137/819 |

OTHER PUBLICATIONS

General Electric Company, "Fabrication Techniques", Fluids Amplifier State of the Art, vol. I, p. 8-7, 12/3/1963.

*Primary Examiner*—L. T. Hix
*Assistant Examiner*—Douglas S. Lee
*Attorney, Agent, or Firm*—Gregory A. Welte; Derek P. Lawrence

[57] ABSTRACT

An invention is disclosed in which a fluidic counter generates fluidic switching signals in response to a fluidic oscillator for sequentially activating a plurality of fluidically activated electrical switches for multiplexing a plurality of electrical conductors into a single conductor.

4 Claims, 15 Drawing Figures

PNEUMATIC SIGNAL MULTIPLEXER

The invention relates to electrical signal multiplexers, and more particularly, to multiplexers of this type which utilize fluidic oscillators and fluidic counters to sequentially address a plurality of electrical signal channels and to connect each channel in turn to a single channel.

BACKGROUND OF THE INVENTION

It is frequently desired to collect data at many different points in space in a high temperature environment such as that found within a gas turbine engine. The data collected can include temperature and pressure information. In general, the number of points at which data is to be collected is desired to be as large as possible in order to maximize the information obtained concerning the environment. Thus, a large number of data transducers must be used. The signals generated by the transducers must be transmitted from each to a common recording or processing station. In the case of electrical signals, this requires that a separate transmitting wire or pair of wires be provided for each transducer. Further, if the transducers are to be located on a rotating component of the gas turbine engine, additional factors must be accommodated: (1) The signals carried by the rotating wires must be transmitted to a nonrotating processing station. This is generally accomplished by utilized slip rings, one for each wire, or by utilizing a radio telemetry transmitter. (2) The transmitting wires can experience centrifugal forces in excess of 10,000 g's; consequently, the wires must be securely fastened along their entire lengths to the rotating component to prevent movement of the wires as well as mechanical damage to them. (3) The high centrifugal forces involved necessitate that the transmitting wires be arranged in a symmetrical manner to achieve nearly perfect dynamic balance. The accommodation of all of these three factors requires a duplication in both effort and material. Furthermore, sometimes engine design choices and space limitations make it impossible to route the necessary number of wires from the rotating transducers to a point where the signals are transferred from the wires to the collection station. Thus, a frequent result is that the number of wires is reduced by eliminating transducers.

It is also desirable to obtain data by means of transducers located within a hostile environment, such as within a pressurized steam containment vessel. In such a vessel, it is desirable to minimize the number of electrical conduits which penetrate through holes in the wall of the vessel because the holes decrease the strength of the walls and each hole provides an additional potential site for leakage to occur.

In all cases generally, if a multiplexer is used to multiplex the signals produced by numerous transducers onto a single output channel, energy must be delivered to the multiplexer to sustain its operation. The energy delivery can encounter the usual problems of delivering electricity to a rapidly rotating shaft in a gas turbine engine or to the interior of a pressurized steam containment vessel.

OBJECTS OF THE INVENTION

It is an object of the present invention to provide a new and improved electrical signal multiplexer.

It is a further object of the present invention to provide a new and improved electrical signal multiplexer which can withstand a high temperature and high g-field environment.

It a further object of the present invention to provide a new and improved electrical signal multiplexer which is powered by energy obtained from a fluid pressure gradient which is inherently present in the environment in which the multiplexer operates.

It is a further object of the present invention to provide a signal multiplexer which utilizes fluidic circuitry to sequentially activate a plurality of fluidically activated electrical switches.

SUMMARY OF THE INVENTION

In one form of the present invention, fluidic switching circuitry is utilized to sequentially activate a plurality of mechanical switches to sequentially connect each of a plurality of electrical signal channels to a single channel.

DETAILED DESCRIPTION OF THE INVENTION

Figure 1:
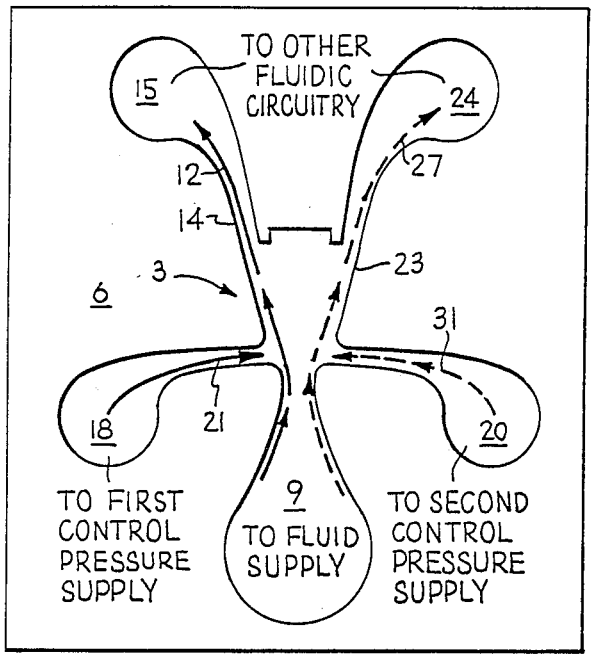
FIG. 1 illustrates a fluidic switching device.

A description of the operation of a fluidic switching device will first be given in order to illustrate some of the fluidic principles applied by the present invention. FIG. 1 illustrates one such device. That Figure illustrates a cavity 3 contained within a housing 6. A supply port 9 supplies a fluid such as air under pressure from a source (not shown) which fluid can flow along a flowpath indicated by arrows 12. The arrows 12 represent a fluid stream which adheres to one of the walls of the cavity 3 such as a first wall 14 and continues to travel along first wall 14 to one of the output ports such as first output port 15. First output port 15 leads to further fluidic circuitry (not shown) having components which can resemble the device of FIG. 1, or first output port 15 may lead to a fluid operated switch (not shown) which is activated by the fluid stream 12. Control ports 18 and 20 are connectible to other sources of pressurized air, such as first and second control pressure supplies (not shown). If control port 18 is connected to one of these other sources, a jet or stream of air 21 enters the cavity 3 through control port 18 and pushes or drives the airstream 12 away from the first wall 14 and over to a second wall 23. Consequently, the air supplied by the supply port 9 now flows along wall 23 and out through a second output port 24 as indicated by dashed arrow 27. The second output port 24 can be connected to other fluidic circuitry (not shown) or to a fluid-activated switch (not shown). Thus, the device illustrated can accomplish a fluidic switching function: it can switch a fluid stream from one output port to another. Application of fluid pressure to the second control port 20 will result in a fluid jet 31 acting to drive the fluid stream 27 to first wall 14. It is to be noted that this description is illustrative only and the particular operation of a particular fluidic switching device will depend upon many factors, such as the device geometry, the characteristics of the fluid used, including its density and viscosity, as well as the pressures and temperatures under which the fluid operates.

Figure 2A:
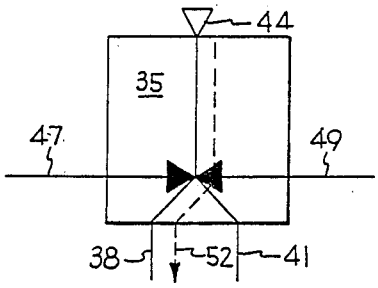
FIGS. 2A–E illustrate schematic diagrams used for fluidic switching circuitry, including the switching device of FIG. 1.

FIGS. 2A–E illustrate five of the different symbols utilized herein to represent three different kinds of fluidic switching devices and two associated devices. Symbol or device 35 in FIG. 2A represents a fluidic amplifier whose operation can be understood as follows. Lines 38 and 41 represent output ports, triangle 44 represents a supply port and lines 47 and 49 represent control ports. The term "line" herein refers to a fluid conduit or pipe. A fluid such as air will flow from the supply port 44, through the device, and out through one of the output ports, such as output port 38 as indicated by dashed arrows 52. Application of fluid pressure to the control port 47 will cause the pressure of the air flowing through the output port 38 to increase. Thus, as described so far, the device 35 acts as a pressure amplifier. When the air pressure at control port 47 reaches a switching threshold pressure, the airstream will switch from output port 38 to output port 41 in a manner analogous to that described in connection with the device of FIG. 1. Similarly, if air pressure is then applied to control port 49, the pressure of the airstream present at output port 41 will increase until a switching threshold is reached at control port 49 at which time the airstream switches back to output port 38. It should be noted that if air pressure is initially absent from both control ports 47 and 49 and pressurized air is applied to supply port 44, the output port 38 or 41 through which the stream 52 then flows will, in general, be randomly determined.

Figure 2B:
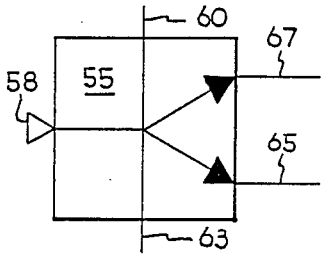
Figure 2C:
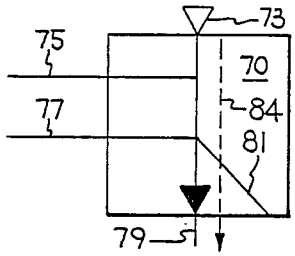

Device 55 in FIG. 2B illustrates a fluidic flip-flop. Triangle 58 represents a supply port, lines 60 and 63 represent control ports and lines 65 and 67 represent output ports. Its manner of operation is similar to that of fluidic amplifier 35 in the sense that application of fluid pressure to the control port 60 will cause air flowing through output port 67 to switch to output port 65 and pressure applied to control port 63 will cause air flowing through output port 65 to switch to output port 67. However, no significant pressure amplification function is utilized in the flip-flop 55. (Of course, as the discussion above indicates, the fluidic amplifier 35 can be used as the fluidic flip-flop 55.) Symbol 70 in FIG. 2C represents a fluidic NOR-gate. Triangle 73 represents a supply port, lines 75 and 77 represent control ports, line 79 represents an output port and line 81 represents a vent. In terms of the device of FIG. 1, output port 79 is analogous to output port 15 in FIG. 1 and vent 81 is analogous to output port 24. The operation of the fluidic NOR-gate 70 can be understood as follows. In the absence of air pressure at both control ports, an airstream flows from the supply port 73 through the device and out the output port 79 as indicated by dashed arrows 84. If sufficient air pressure is applied to either or both control ports 75 and 77, the airstream 84 is diverted away from output port 79 and into vent 81.

The following terms are defined for use herein. An airstream flowing through an output port is represented as a "1" for purposes of binary logic symbolism. The absence of an airstream at an output port is represented as logical "0". The presence of air pressure at a control port of a device, which pressure is sufficient to cause switching or diversion of the airstream away from the output port of the device through which it is currently flowing, is represented as a logical "1". The absence of sufficient air pressure at a control port to cause switching is represented as logical "0". Accordingly, NOR-gate 70 has associated with it the truth table shown in Table 1.

TABLE 1

| Control Port 75 | Control Port 77 | Output Port 79 |
|---|---|---|
| 0 | 0 | 1 |
| 0 | 1 | 0 |
| 1 | 0 | 0 |
| 1 | 1 | 0 |

Table 1 can be understood as follows. The two "0's" in the left column of the first row indicate that a logical "0" is present at both control ports 75 and 77 of NOR-gate 70. The right column indicates that under such control port conditions, a logical "1" is present at the output port 79. The second row indicates that for air pressure present at control port 77 but absent at control port 75, a logical "0" appears at output port 79. The third row indicates that for switching pressure present at control port 75 but absent at control port 77, a logical "0" appears at output port 79. The fourth row indicates that for switching pressure present at both control ports 75 and 77, a logical "0" appears at output port 79. Table 1 represents the NOR function in the terminology of switching logic and, hence, accounts for the name of NOR-gate 70.

Figure 2D:
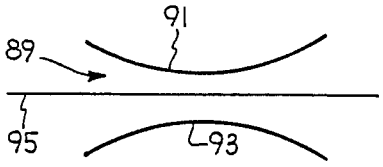
Figure 2E:
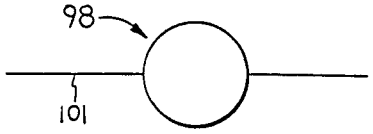

Symbol 89 in FIG. 2D represents a fluidic resistor in that arcs 91 and 93 symbolize a constriction in a line 95 which constriction resists the flow of fluid. Symbol 98 in FIG. 2E represents a fluidic capacitor in that circle 98 represents an expansion present in a line 101, which expansion has the capacity to contain fluid.

Figures 3, 5:
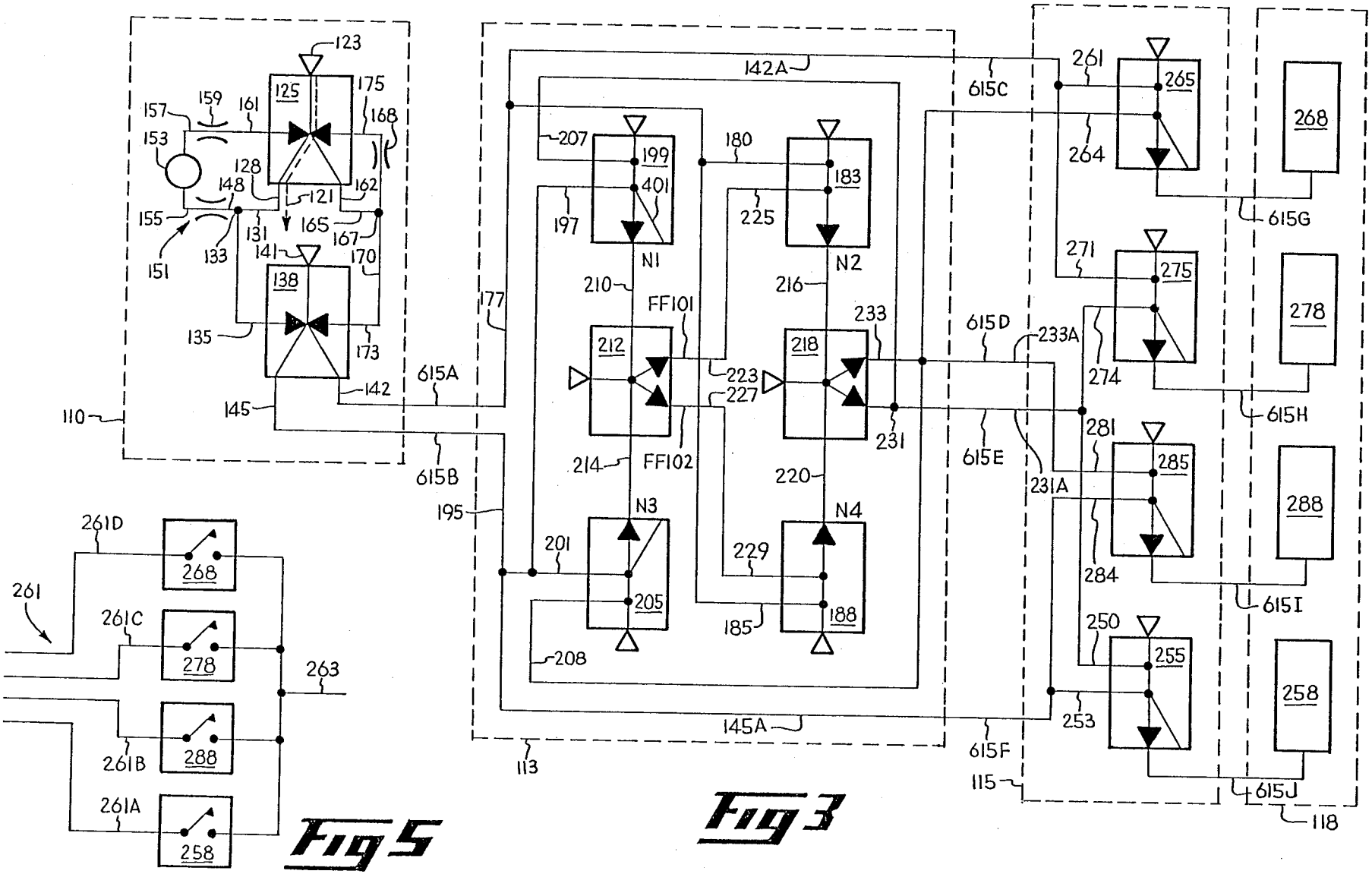
FIG. 3 illustrates a schematic diagram of one form of the present invention.
FIG. 5 illustrates four switches used to multiplex four signal channels into a single channel.
Figure 4:
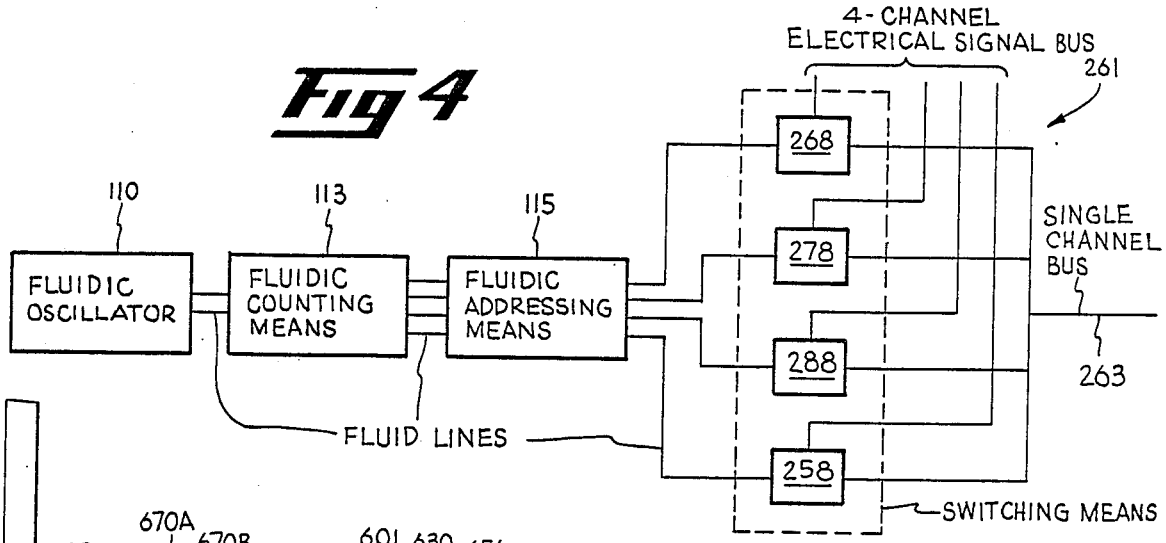
FIG. 4 illustrates a block diagram of one form of the present invention.

FIG. 3 illustrates a multiplexing circuit comprising the fluidic switching devices of FIGS. 2A–C. FIG. 3 illustrates a fluidic oscillator means contained in dotted block 110, a fluidic counter means contained within dotted block 113, fluidic addressing means contained within dotted block 115 and a switching means comprising a plurality of fluidically operated electrical switches contained in dotted block 118. The circuit of FIG. 3 is shown as a block diagram in FIG. 4.

The operation of oscillator means 110 in FIG. 3 is as follows. It is assumed that the airstream initially follows the path indicated as dashed arrow 121, that is, from the supply port 123 of a first fluidic amplifier 125 through output 128 along line 131 to a junction 133 and thence to a control port 135 of a second fluidic amplifier 138. The pressure at control port 135 forces the airstream flowing from supply port 141 of the second fluidic amplifier 138 to flow through output port 142, thus providing a logical "1" at that output port and a logical "0" at output port 145. However, at junction 133, air pressure is also fed along a line 148 to a constriction or resistor 151 in that line and thence to a capacitor 153 by means of a line 155. Air pressure is fed from capacitor 153 by means of a line 157 through a second resistor 159 and thence to control port 161 of the fluidic amplifier 125. Thus, the pressure at the output port 128 is fed back to the control port 161, causing the airstream 121 to eventually switch away from that same output port 128. However, before this latter switching occurs, the combined action of resistors 151 and 159, together with the capacitor 153, delay the application of the feedback of pressure to control port 161 so that pressure can be first applied to control port 135 of the fluidic amplifier 138 to cause a logical "1" to appear at output port 142 for a period of time until the pressure signal travels through the resistors 151 and 159 and capacitor 157 to control port 161.

When the pressure signal reaches the control port 161, the airstream in the fluidic amplifier 125 is switched to output port 162. From the output port 162, a pressure signal is fed along a line 165 to a junction 167 and then to a line 170 which applies the pressure signal to a control port 173 of the fluidic amplifier 138, thus causing the airstream flowing from output port 142 to switch and to flow through output port 145. Thus, after this switching, a logical "1" is present at output port 145 and logical "0" is present at output port 142. However, the pressure signal present at junction 167 is also fed back through a resistor 168 (used for delay in a manner similar to the delay for which resistors 151 and 159 are employed) to a control port 175 of the fluidic amplifier 125 to switch the fluidic amplifier 125 into its initial state as described above. This switching cycle proceeds continuously. Thus, it can be seen that oscillator means 110 changes its state and provides pressure signals at output port 145 having the following sequence: 1010101, etc. Simultaneously, at output port 142, a signal is provided which is the opposite of that at output port 145. (Logical "0" is considered to be the opposite of logical "1".)

The output of oscillator means 110 is applied to counting means 113 to selectively address switches in switching means 118 as follows. Output port 142 is connected by means of a line 177 to a control port 180 of NOR-gate 183 as well as to control port 185 of NOR-gate 188. If the pressure signal present on line 177 is logical "1", then both outputs of NOR-gates 183 and 188 will be zero. Output port 145 of fluidic amplifier 138 is connected to line 195 which is connected to control port 197 of NOR-gate 199, as well as to control port 201 of NOR-gate 205. In the case just mentioned, where the pressure signal at line 177 is logical "1", then the pressure signal present at line 195 will be logical "0" due to the characteristics of the oscillator means 110. In such a case, the outputs of NOR-gates 199 and 205 are not yet determined.

These outputs will be determined by the pressure signals applied to control inputs 207 and 208, respectively. The output of NOR-gate 199 is connected to a control input 210 of a flip-flop 212. The output of NOR-gate 205 is connected to a control input 214 of flip-flop 212. The output of NOR-gate 183 is connected to a control input 216 of a flip-flop 218 and the output of NOR-gate 188 is connected to a control input 220 of the flip-flop 218. The output 223 of flip-flop 212 is connected to the input 225 of NOR-gate 183 while the output 227 of flip-flop 212 is connected to control input 229 of NOR-gate 188. The output 231 of flip-flop 218 is fed back to the control input 207 of NOR-gate 199 and the output 233 of flip-flop 218 is fed back to the control input 208 of NOR-gate 205.

Under the circumstances as so far described, the outputs of both NOR-gates 199 and 205 are indeterminate (although it is known that the signal at the output of NOR-gate 199 is opposite that at the output of NOR-gate 205) because a pressure signal of logical "1" has not been described as being applied to any of the control inputs of these NOR-gates. Let it be assumed that the output 227 of flip-flop 212 carries a pressure signal of logical "1". As a consequence, the output 223 of this flip-flop will carry a pressure signal of logical "0". Also, as a consequence, a pressure signal of logical "1" is fed to control input 229 of NOR-gate 188, thereby producing a pressure signal of logical "0" at control input 220 of flip-flop 218. Flip-flop 218 thus produces signals of logical "1" and "0" at outputs 233 and 231, respectively. The signal of logical "0" at output 231 is fed back to the control input 207 of NOR-gate 1, thus producing a signal of logical 1 at this NOR-gate's output, which is in turn applied to control input 210 of flip-flop 212. Thus, output 223 carries a pressure signal of logical "0" and output 227 carries a pressure signal of logical "1". These signals, when transmitted respectively to the control inputs 225 and 229 of respective NOR-gates 183 and 188 do not change the outputs of these NOR-gates.

Lines 142A, 145A, 231A and 233A (connected respectively to outputs 142, 145, 231, and 233) comprise an output fluidic signal bus and, at this stage in the description, carry logical signals of 1, 0, 0, and 1, respectively. Lines 231A and 145A are connected respectively to the control inputs 250 and 253 of a NOR-gate 255 the output of which is connected to a pneumatically operated electrical switch 258. As shown in FIG. 5, switch 258 is connected between one conductor 261A of a four-conductor electrical signal bus 261 and the single conductor 263 of a one-conductor signal bus. Lines 142A and 233A are respectively connected to the control inputs 261 and 264 of a NOR-gate 265, the output of which is connected to the input of a second pneumatically operated electrical switch 268. As FIG. 5 shows, switch 268 is connected between a second conductor 261D of the bus 261 and the single conductor 263. Lines 142A and 231A are connected to the control inputs 271 and 274 of a NOR-gate 275, the output of which is connected to the input of a third pneumatically operated electrical switch 278. As FIG. 5 shows, switch 278 is connected between a third electrical conductor 261C, bus 261 and the single conductor 263. Lines 145A and 233A are respectively connected to control inputs 284 and 281 of a NOR-gate 285, the output of which is connected to the input of a pneumatically operated electrical switch 288. As FIG. 5 shows, switch 288 is connected between the fourth conductor 261B of the bus 261 and the single conductor 263.

The switches, such as switch 258, for example, can comprise the invention described in the patent application by Danny L. Fenwick and Jon D. Hopkins, entitled "Pneumatic Ball Contact Switch," Ser. No. 443,826, filed Nov. 22, 1982, patentability allowed April 30, 1984, concurrently filed herewith and assigned to a common assignee. Another such switch is that disclosed in the patent application of Paul M. Clark, Danny L. Fenwick, and Jon D. Hopkins, entitled, "Pneumatic Reed Switch," U.S. Pat. No. 4,468,532, which is also concurrently filed and assigned to a common assignee. Both of these applications are hereby incorporated by reference.

As mentioned, lines 142A, 145A, 231A, and 233A carry signals, respectively, of logical 1, 0, 0, and 1. Thus, of NOR-gates 255, 265, 275, and 285, the only NOR-gate receiving signals of logical 0 at both inputs is NOR-gate 255. Thus, of these four NOR-gates, only NOR-gate 255 produces a signal of logical 1 at its output. As stated, this output is connected to the input of pneumatic switch 258. The application of a logical "1"

signal to the input of switch 258 closes the switch to connect the first conductor 261A in bus 261 with the output conductor 263.

The situation just described can be expressed by the first row in the truth table designated Table 2.

TABLE 2

| Outputs | | NOR-gates | | | | Flip-Flops | | | | Lines | | | |
|---|---|---|---|---|---|---|---|---|---|---|---|---|---|
| 142 | 145 | 199 | 183 | 205 | 188 | 223 | 227 | 231 | 233 | 142A | 145A | 231A | 233A |
| 1 | 0 | 1 | 0 | 0 | 0 | 0 | 1 | 0 | 1 | 1 | 0 | 0 | 1 |
| 0 | 1 | 0 | 1 | 0 | 0 | 0 | 1 | 1 | 0 | 0 | 1 | 1 | 0 |
| 1 | 0 | 0 | 0 | 1 | 0 | 1 | 0 | 1 | 0 | 1 | 0 | 1 | 0 |
| 0 | 1 | 0 | 0 | 0 | 1 | 1 | 0 | 0 | 1 | 0 | 1 | 0 | 1 |

When oscillator means 110 changes state (that is, undergoes an oscillation), the conditions of the second row in Table 2 occur and logical "0" is applied to both control inputs of NOR-gate 265, the output of which closes switch 268 to connect conductor 261D of bus 261 with the conductor 263. Upon the third oscillation of oscillator means 110, the situation of line 3 in Table 2 obtains and the control inputs of NOR-gate 285 both receive logical "0" signals and switch 288 is closed to connect the third conductor 261B of bus 261 with the conductor 263. Upon the fourth oscillation of oscillator means 110, the conditions of line 4 in Table 2 occur with the result that logical "0's" are applied to both control inputs of NOR-gate 275, closing switch 278 to thereby connect the fourth conductor 261C of bus 261 with the conductor 263. These ocillations preferably occur at a frequency of one hertz. Examination of Table 2 will show that when one of the switches 258, 268, 278 or 288 is closed, the rest are open due to the combination of signals applied to NOR-gates 255, 265, 275, and 285. As oscillator means 110 continues to oscillate, this four-step sequence continues to sequentially connect conductors 261A, D, B, and then C with the output conductor 263. That is, the four-channel bus 261 is multiplexed to the single channel provided by the output conductor 263.

Figure 6:
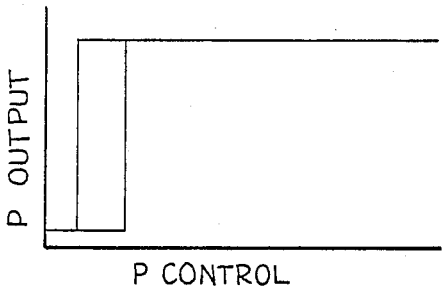
FIGS. 6–8 illustrate plots of pressure characteristics of fluidic switching devices.
Figure 7:
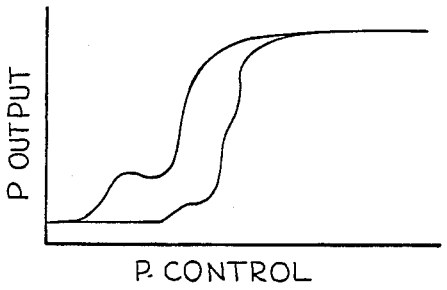
Figure 8:
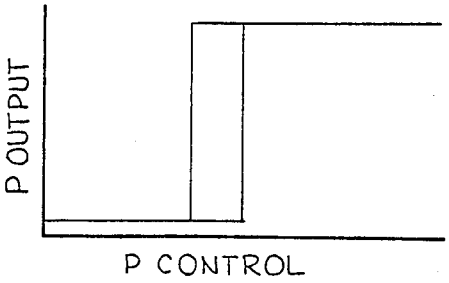

The following implementation of oscillator means 110 has been undertaken. A fluidic amplifier, Model DW-32, available from TriTec, Inc., Columbia, Md., was utilized for the fluidic amplifier, such as amplifier 125 in FIG. 3. A two-input NOR-gate, Model DN-32, was utilized for the NOR-gates, such as NOR-gate 199, and a flip-flop Model DF-32, was utilized for the flip-flops, such as flip-flop 212. The lines, such as line 195 in FIG. 3 comprised capillary tubing of 0.023 in. (0.058 cm) inside diameter. Air actuator-type cylinders were used as variable capacitors, such as 153, and needle valves blocking part of the interior of the lines were used as variable resistors, rather than nonvariable resistors, such as 159, during the test. An oscillator means resembling that shown in FIG. 3 was tested at room temperature and at 950° F. The outputs 142 and 145 were blocked-loaded. It was found that the sensitivities of the fluidic devices decreased with increasing temperature. That is, ordinarily, a plot of the output pressure as a function of the pressure at the control port for a DN-32 element resembles that given in FIG. 6. However, at 1300° F., the plot was found to resemble that shown in FIG. 7. It was further found that the sensitivity at elevated temperature was dependent upon the output loading. For example, when the vent 401 of a NOR-gate such as 199 in FIG. 3 was left open to atmosphere (as opposed to being block-loaded) and output 210 was connected to a control input of another DN-32 device, the plot of FIG. 8 was obtained.

Figure 9:
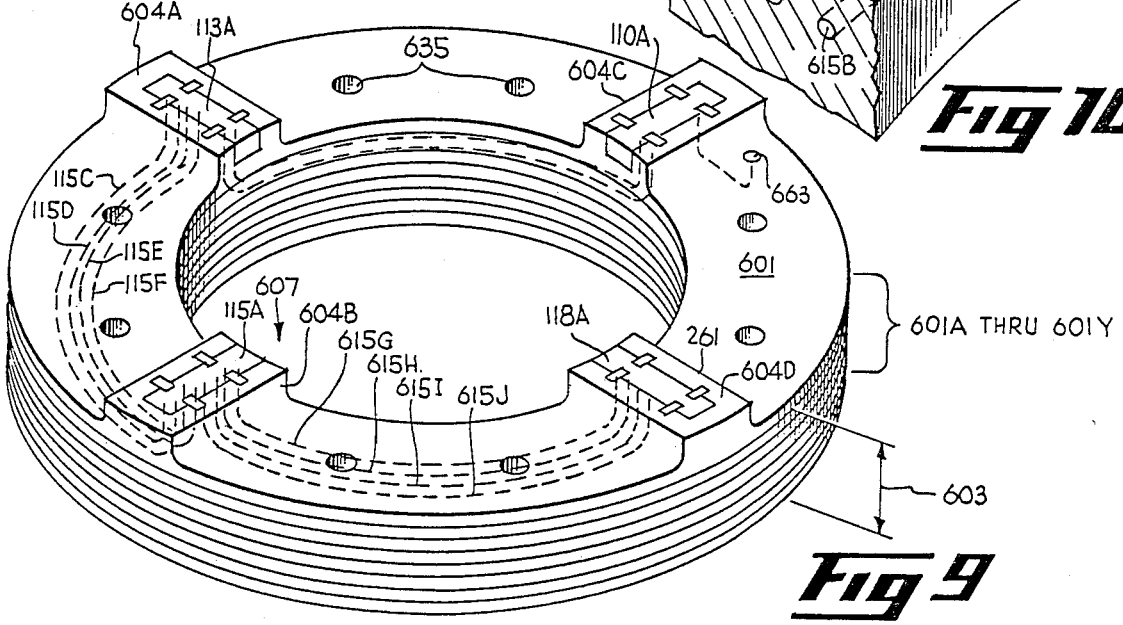
FIG. 9 illustrates another form of the present invention.

As shown in FIG. 9, oscillator means 110, counting means 113, addressing means 115, and switching means 118 of FIG. 1 are shown mounted in a circular ring 601. The ring 601 is preferably comprised of a stack of separate rings 601A–Y constructed of Inconel 718 metal and each being 0.004 in. (0.010 cm.) thick. Thus, a 25-layered stack would be 0.100 in. (0.254 cm) thick, the thickness being dimensioned 603, 0.100 in. (0.254 cm) being the preferred thickness of the ring. Four support brackets 604A–D are attached to the surface of the ring 601 by diffusion bonding. Each bracket is preferably 0.300 in. high, namely dimension 607 in FIG. 10, 1 in. long, which is dimension 609, and each wall of the bracket 604A–D is preferably 0.15 in. (0.381 cm) thick, which is dimension 611. Each wall bears a fillet 610 having a fillet radius of 0.10 in. (0.254 cm) which is dimension 610A.

Figure 10:
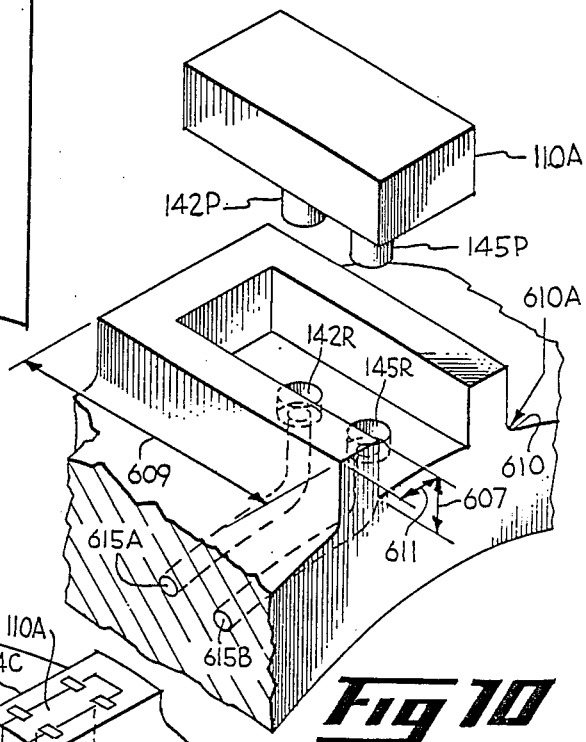
FIG. 10 further illustrates a portion of FIG. 9.

The components contained in the dotted blocks 110, 113, 115, and 118 in FIG. 3 are constructed so that they are formed in individual modules 110A, 113A, 115A, and 118A shown in FIG. 9 (module 110A is shown in FIG. 10 as well). The modules are selectively removable from their brackets for servicing. Oscillator means module 110A is constructed so that outputs 142 and 145 in FIG. 3 extend as pipes 142P and 145P, as shown in FIG. 10. The pipes connect with receptacles 142R and 145R and the pipes can be fitted with O-rings and belleville washers (both not shown) for an improved seal. Channels 615A–B are formed in the ring 601 and these channels correspond to the portions of the lines of the same numbers in FIG. 3.

In FIG. 10, the channels are preferably square in cross section and between 0.004 in. (0.010 cm) and 0.008 in. (0.020 cm) on a side. The other modules 113A, 115A, and 118A are fitted into respective brackets 604B, 604C, and 604D in a similar manner, these modules having pipes corresponding with pipes 142P and 145P, these brackets having receptacles corresponding to receptacles 142R and 145R. Modules 113A and 115A are connected with channels 615C–F, which correspond with the line portions of the same numbers in FIG. 3. Modules 115A and 118A are connected by channels 615G–J, which correspond to line portions in FIG. 1 having the same numbers. Electrical conductor 261 in FIG. 10 corresponds to the four channels of the signal bus 261 shown in FIGS. 4 and 6. Switches contained in switching means module 118 in FIG. 10 multiplex this four-channel bus into the single conductor of the output bus 263, shown in FIGS. 4, 6, and 10.

Figure 11:
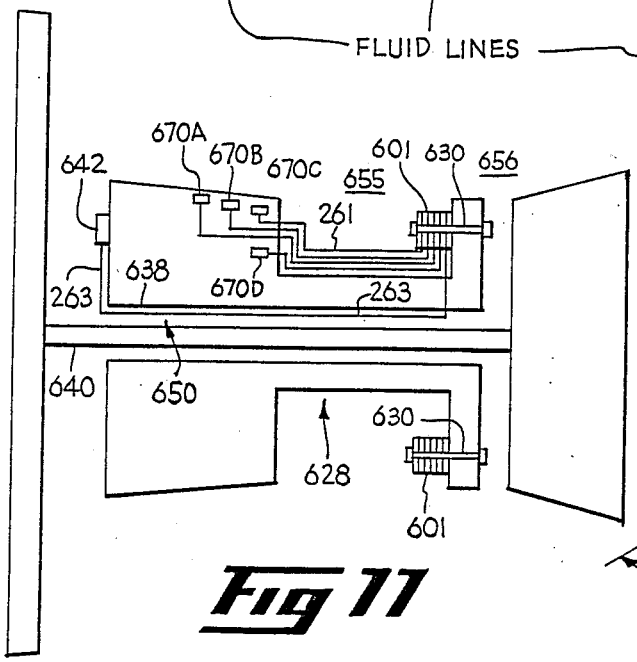
FIG. 11 illustrates the invention of FIG. 9 mounted in a gas turbine engine.

In FIG. 11, the ring 601 is shown bolted to a turbine rotor 625 of a gas turbine engine 628 by bolts 630 which pass through holes 635 in FIG. 9. Each conductor of the four-channel bus 261 is connected to one of transducers 670A–D. The output bus 263 extends along and between rotating shafts 638 and 640 to a telemetry broadcasting station 642. The broadcasting station 642 transmits the information contained on output line 263 as a radio frequency signal which is picked up by an external receiver (not shown). Of course, slip rings (not shown)

could be used to connect the output line 263 with the receiver, but in many cases, the high speeds involved tend to mechanically wear out slip rings very rapidly. In addition, one of the reasons that a single wire, or at most a very small number of wires, is positioned along the shafts in the region designated 650, is that space limitations are critically small. Thus, only a limited number of wires can be extended through this region 650.

A pressure gradient generally exists between regions 655 and 656. This gradient is used to supply operating power to the present invention by connecting the supply ports indicated by triangles, such as triangle 123 in FIG. 3 of each module to a supply orifice, such as orifice 663 in FIG. 9. It has been found that the centrifugal force in regions 655 and 656 tends to fling dust particles away from the ring 601 in FIG. 11, so that the particles generally do not enter the supply orifice 663. Thus, it can be feasible to operate the invention in a turbine engine without filters present at the supply ports, such as port 123.

An invention has been described which multiplexes a plurality of signal channels onto a single output channel. Further, the invention utilizes fluidic circuitry to generate a plurality of fluidic signals successively at a plurality of the inputs of fluidic activated mechanical switches. Still further, the invention receives operating power from the environment in which it is contained, thus requiring no external power source. Further still, the multiplexing circuitry is contained in removable modules which facilitate troubleshooting and repair. The invention is capable of operation in a high-temperature, high-centrifugal force environment.

Numerous modifications and substitutions can be undertaken without departing from the true spirit and scope of the present invention as defined in the following claims. In particular, the outputs as shown in Table 2 of NOR-gates 199, 183, 205, and 188 could be used to activate the pneumatic switches 258, 268, 278, and 288, provided that these NOR-gates are designed to accommodate the fan-out of these pneumatic switches.

What is sought to be protected by Letters Patent is the following.

We claim:

1. A signal multiplexer, comprising:

(a) fluidic oscillator means for generating a sequence comprising the occurrence of fluidic oscillator signals and the absence of these signals;

(b) fluidic counter means coupled to the fluidic oscillator means for generating a fluidic switching signal at each of a selected plurality of fluid conduits in response to the occurrence of fluidic oscillator signals and in a predetermined sequence;

(c) a plurality of fluidically activated electrical switches fluidically connected to respective ones of the fluid conduits of (b) and electrically connected between respective input conductors and an output conductor for connecting each respective input conductor with the output conductor in response to the fluidic switching signals of (b), some of the switches including (i) a conductor having a portion fastened to a housing and a portion movable with respect to the fastened portion;

(ii) a plurality of terminals fastened to the housing; and (iii) a passage adjacent to the conductor for applying fluid pressure to force the movable portion into contact with at least one of the terminals.

2. A signal multiplexer, comprising:

(a) fluidic oscillator means for generating a sequence comprising the occurrence of fluidic oscillator signals and the absence of these signals;

(b) fluidic counter means coupled to the fluidic oscillator means for generating a fluidic switching signal at each of a selected plurality of fluid conduits in response to the occurrence of fluidic oscillator signals and in a predetermined sequence;

(c) a plurality of fluidically activated electrical switches fluidically connected to respective ones of the fluid conduits of (b) and electrically connected between respective input conductors and an output conductor for connecting each respective input conductor with the output conductor in response to the fluidic switching signals of (b), some of the switches including (i) a chamber, (ii) at least two insulated conductors leading into the chamber, (iii) a movable contact element contained within the chamber, and (iv) a first fluid passage communicating with the chamber for admitting fluid pressure to move the contact member into contact with the conduits.

3. A signal multiplexer, comprising:

(a) fluidic oscillator means for generating a sequence comprising the occurrence of fluidic oscillator signals and the absence of these signals;

(b) fluidic counter means coupled to the fluidic oscillator means for generating a fluidic switching signal at each of a selected plurality of fluid conduits in response to the occurrence of fluidic oscillator signals and in a predetermined sequence;

(c) a plurality of fluidically activated electrical switches fluidically connected to respective ones of the fluid conduits of (b) and electrically connected between respective input conductors and an output conductor for connecting each respective input conductor with the output conductor in response to the fluidic switching signals of (b);

(d) a laminated ring in which at least some of the laminations have one dimension under 0.004 inch to which the fluidic oscillator means, fluidic counter means, and the electrical switches are mounted;

(e) addressing means attached to the ring; and (f) channels in the ring, some of which are defined by slots in at least one lamination, which fluidically couple (i) the oscillator means with the fluidic counter means, (ii) the fluidic counter means with the addressing means, and (iii) the addressing means with the switching means.

4. A signal multiplexer according to claim 3 and further comprising means for receiving pressurized gas from a gas turbine engine and supplying the gas to the fluidic oscillator means, counting means and addressing means.

* * * * *